United States Patent [19]

Leonard et al.

[11] Patent Number: 4,736,849

[45] **Date of Patent: * Apr. 12, 1988**

[54] CALENDAR-ORIENTED PILL DISPENSER

[76] Inventors: Walter G. Leonard, 1017 Main St., Melrose, Mass. 02176; Henry P. Doble, Jr., Sunnyview Dr., Redding, Conn. 06875; Walter S. Nuckols, 119 Putnam Park Rd., Bethel, Conn. 06801

[ * ] Notice: The portion of the term of this patent subsequent to Aug. 13, 2002 has been disclaimed.

[21] Appl. No.: 764,945

[22] Filed: Aug. 12, 1985

Related U.S. Application Data

[63] Continuation-in-part of Ser. No. 563,148, Dec. 19, 1983, Pat. No. 4,534,468.

[51] Int. Cl.[4] ..... B65D 85/56; B65D 83/04

[52] U.S. Cl. ..... 206/534; 116/308; 206/459

[58] Field of Search ..... 206/531, 532, 534, 539, 206/459; 116/308

[56] References Cited

U.S. PATENT DOCUMENTS

| | | | |
|---|---|---|---|
| 3,283,885 | 11/1966 | Grunewald et al. | 206/534 |
| 3,324,995 | 6/1967 | Sharp, Jr. | 206/534 |
| 3,381,808 | 5/1968 | McGraw, II | 206/534 |
| 3,494,322 | 2/1970 | Dubbels | 206/531 |
| 3,651,927 | 3/1972 | Richardson et al. | 206/534 |
| 4,158,411 | 6/1979 | Hall et al. | 206/531 |
| 4,169,531 | 10/1979 | Wood | 206/531 |
| 4,295,567 | 10/1981 | Knudsen | 206/534 |
| 4,318,471 | 3/1982 | Kerpe | 206/534 |
| 4,534,468 | 8/1985 | Nuckols et al. | 206/534 |

OTHER PUBLICATIONS

Printed brochure for Paco Laboratories, Inc., "If You Require Clinical Study", Jun. 1982.

*Primary Examiner*—Joseph Man-Fu Moy
*Attorney, Agent, or Firm*—Mattern, Ware, Stoltz & Fressola

[57] ABSTRACT

A method and apparatus to store and aid in the dispensing of calendar-oriented drugs is disclosed in which the apparatus comprises a carrier containing a plurality of pill-containing enclosures, the enclosures arranged in rows. Numerical and/or alphanumerical indicia are associated with the enclosures so that each enclosure is associated with only one day in a calendar month. One or more additional enclosures in different rows may also be associated with the same calendar date. Corresponding indicia on the reverse side of the carrier aid in the determination of which enclosure(s) to open. In this way the user can easily determine and verify that the proper enclosure(s) has been opened. The package also provides a visual indication of calendar days for which pills have not been used by the patient and in this way provides patient compliance information to the physician prescribing such drugs. The dispensing apparatus is particularly suited to the administration of calendar-oriented prescription drugs for the treatment of menopausal symptoms.

58 Claims, 2 Drawing Sheets

CALENDAR-ORIENTED PILL DISPENSER

CROSS-REFERENCE TO RELATED APPLICATION

The present application is a continuation-in-part of U.S. patent application Ser. No. 06/563,148, filed Dec. 19 1983 for a Calendar-Oriented Pill Dispenser now U.S. Pat. No. 4,534,468.

TECHNICAL FIELD

The present invention is directed to the packages and methods for dispensing pills and particularly packages for dispensing calendar-oriented drugs.

BACKGROUND ART

Many types of drugs are taken over a variety of days in varying amounts in order to provide for their effective administration. Packages have been developed for aiding the user of such drugs to comply with proper administration of those drugs over a period of days. Typical of such drugs are birth control pills which are taken over a period of days corresponding to a woman's menstrual cycle and the administration of anti-inflammatory drugs such as cortisone and cortisone-like drugs for the treatment of various ailments. The dispensing apparatus associated with such multiple day administered drugs are typically directed to the administration of drugs irrespective of the particular day of the month and indeed are typically administered so as to be timed to a body (circadian) cycle.

The present invention is directed to the administration of drugs in pill form whose administration is based upon the actual calendar date and thus is geared to initial administration on the first day of a given month. Thereafter, the patient continues to take the pill or pills on a daily basis, corresponding to the days of the month. If the patient fails to take the pill or pills for a given day, he or she merely takes the pill or pills for the following day leaving those for the previous day in the dispensing package. In this way, a complete verifiable record of patient compliance is available to the attending physician, thereby allowing the physician to be better able to determine what course of action to take depending upon the degree of patient compliance.

The present invention is particularly suited for the administration of drugs for the treatment of menopausal symptoms. It is known that during the natural course of a woman's life she will experience a decrease in estrogen production normally between the ages of 45 and 55. Such decrease in estrogen production can also be caused by surgical removal of the ovaries. In either case, when the amount of estrogen in the blood begins to decrease, a woman may develop various symptoms including the feelings of warmth in the face, neck or chest; or sudden intense episodes of heat and sweating throughout the body (typically known as "hot flashes") with the severity of these symptoms varying from woman to woman. Some women also may develop atrophic vaginitis which can cause discomfort. In order to treat these symptoms, estrogens may be prescribed by the attending physician for a period of a few months or longer while the woman's body begins to adjust to her lower estrogen production levels.

It has also been discovered that a woman with lower estrogen production usually has rapid loss of bone density with a resultant weakening of the structural integrity of the bones, thus increasing the risk of fracture.

This general condition is known as osteoporosis; and, as reported in the *Update of the Journal of the American College of Obstetricians and Gynecologists,* volume 7, Number 4, pages 2–3 (for year 1981) and Volume 8, Number 2, page 1 (for year 1982) it has been estimated that 25 percent of menopausal women will have fractures related to osteoporosis. A treatment for this problem is the administration of estrogen, progesterone and calcium to the patient, taken over the course of each calendar month. It has been recommended in these articles that post-menopausal women should take some form of calcium replacement in order to replenish the calcium which is lost as a result of reduced estrogen and progesterone production.

The present invention is a calendar-oriented prescriptive drug dispenser (and method) which can, in one embodiment, provide estrogen, progesterone, and calcium to a patient under the care of a gynecologist or other physician. In order to facilitate patient compliance, the present invention provides a dispenser in which the days of the month are associated with pill-containing enclosures, each enclosure having a one-to-one correspondence to a single calendar day. The patient is typically instructed to begin the medication on the first day of the next succeeding month and if a day is missed, to simply skip that pill-containing enclosure or enclosures and continue with those for the remainder of the month. At the end of the month the physician, if he or she desires, can by examining the dispenser, ascertain the degree of patient compliance with the prescriptive drugs. It has been experimentally found that women who have used the dispenser according to the present invention have high compliance with the prescriptive drug regimen, while those who are requested to take estrogen, progesterone, and calcium pills over the course of the month without this dispenser have relatively poor compliance with the regimen.

Thus the present invention provides the means for insuring high compliance with a calendar-oriented prescriptive drug regimen and also provides the means for determining the degree of compliance by the attending physician.

The improved dispenser disclosed herein can be easily stored by the patient since the carrier holding the pills in enclosures can be folded upon itself and stored in a relatively small carton.

SUMMARY OF THE INVENTION

A dispenser for containing pills for administration over a period of days associated with a calendar month is disclosed. The dispenser comprises a plurality of pill-containing enclosures, each enclosure containing one pill associated with a prescriptive regimen to be taken by a patient on a given calendar date. Each pill-containing enclosure has a number (or number-letter combination) associated with it corresponding to one calendar date.

More than one enclosure may be associated with a given calendar date. The bottom portion of the enclosure comprises part of a foil sheet which can be selectively ruptured for removal of the pill within the enclosure. Each rupture area or zone has a number (or number-letter combination) in proximity thereto (or on the foil itself) corresponding to the calendar day that appears on the front of the dispenser, thereby facilitating proper pill removal for each enclosure. If the patient forgets to take the pill or pills associated with one or more calendar dates, each enclosure remains in its sealed state; thereby providing a visual means to inform the attending physician of the degree of compliance by the patient to the prescriptive drug regimen.

Preferably the pill-containing enclosures are made from a clear blister-pack type plastic material with an underlying foil backing sheet. The clear plastic enables the patient to see the pill contained within each enclosure. The remainder of the dispenser comprises a carrier preferably formed from flat, relatively stiff material, such as upper and lower cardboard sheets (which may be formed from one folded sheet), so as to provide additional rigidity to allow the patient to easily use the dispenser. The cardboard carrier is preferably folded upon itself so as to allow insertion in a carton with one-half the size of the unfolded carrier.

The calendar indicia on the front and rear surfaces of the carrier are placed adjacent the corresponding pill-containing enclosure although they may also be imprinted on each rupturable zone.

For days in which two or more enclosures are to be dispensed, a separate calendar date indicia may be associated with each enclosure, or one date may be used which is adjacent each such enclosure.

In one preferred embodiment of the present invention the dispenser is for the administration of post-menopausal prescriptive drugs for the treatment of menopausal symptoms and osteoporosis. In this embodiment of the invention, two rows each comprise six pill enclosures (accounting for the first twelve days of the calendar month), wherein each enclosure contains an estrogen replacement pill; while the next six enclosures (days 13–18) are positioned in a third row with three additional enclosures in a fourth row associated with days 16–18 respectively. The enclosures in the third row also each contain an estrogen replacement pill while the enclosures in the fourth row each contain a progesterone pill.

Fifth and sixth rows of pill enclosures are associated with days 19 through 25, one row containing estrogen replacement pills and the other row containing progesterone pills.

The seventh row contains six pill enclosures for days 26 through 31, with each pill enclosure containing a calcium replacement pill.

This dispenser therefore comprises a plurality of pill-containing enclosures corresponding to thirty-one calendar days with one pill enclosure associated with the first fifteen and the last six calendar days and with two pill enclosures associated with the sixteenth through the twenty-fifth calendar days.

The particular calendar month may also be indicated on the dispenser. In this embodiment the patient begins the prescriptive drug regimen on the first day of the next succeeding month and continues taking the pills from the enclosures corresponding to the days of the month. If the month has fewer than thirty-one days, those enclosures corresponding to days which do not exist are simply not used by the patient. Alternatively, the enclosures associated with the extra days can be removed by the attending physician or pharmacist in an embodiment where the carrier is scored for these particular enclosures. With either embodiment, the attending physician can later observe the dispenser after completion of a month's use so as to determine the degree of patient compliance.

OBJECTS OF THE INVENTION

Therefore it is the principal object of the present invention to provide a dispenser for pills to be administered on a calendar oriented basis, wherein the dispenser comprises a plurality of rupturable pill-containing enclosures, each enclosure having an indicia associated with it on both its front and rear surfaces corresponding to one of the days of the month so as to make a one-to-one correlation between each calendar date and one or more pill enclosures each containing one pill to be taken on that calendar date.

Another object of the present invention is to provide a dispenser of the above description in which the pill-containing enclosures have domes formed from a transparent material so that the user can easily ascertain the pill contained therein.

A still further object of the present invention is to provide a dispenser of the above description in which the pill-containing enclosures are arranged in a plurality of rows, wherein at least two rows contain enclosures associated with the same calendar dates.

Another object of the present invention is to provide a dispenser of the above description in which the pill-containing enclosures are formed between a carrier formed from front and rear sheets having cutout portions in the front sheet corresponding to the protruding perimeter of the domes and cutout portions in the rear sheet corresponding to the rupturable zones of the enclosures; and further wherein the indicia on the rear sheet are placed in proximity to the rupturable zones so as to facilitate the determination of which enclosure(s) to dispense for a particular calendar date.

A still further object of the present invention is to provide a dispenser of the above description for use in the administration of calendar-oriented menopausal therapy drugs in which the first three rows of the pill-containing enclosures each have six enclosures containing estrogen pills for the first eighteen calendar days of a month, wherein a fourth row of pill-containing enclosures comprises three enclosures for the storage of progesterone pills, wherein these three enclosures are associated with the sixteenth through eighteenth days of the calendar month, wherein fifth and sixth rows each contain seven pill-containing enclosures for calendar days nineteen through twenty-five, the fifth row containing estrogen pills and the sixth row containing progesterone pills, and wherein a seventh row contains six pill-containing enclosures for calendar days twenty-six through thirty-one, each enclosure containing a calcium replacement pill.

A still further object of the present invention is to provide a dispenser of the above description wherein the days associated with more than one pill-containing enclosure are color coded to facilitate proper identification.

Another object of the present invention is to provide a dispenser of the above description wherein the carrier folds upon itself so as to reduce the overall perimeter of the carrier when not in use, and further wherein the dispenser includes a carton in which the folded carrier can be stored.

A further object of the present invention is to provide a dispenser of the above description which includes score lines to allow the pre-use removal of pill-containing enclosures that correspond to days which are greater than the maximum number of days in the month for which the dispenser is to be used.

Another object of the present invention is to provide a dispenser of the above description which includes indicia for identifying the particular month for which the dispenser is to be used by a patient.

Other objects of the present invention will in part be obvious and will in part appear hereinafter.

DRAWINGS

For a full understanding of the nature and objects of the present invention, reference should be made to the following detailed description taken in connection with the accompanying drawings, in which.

Figure 3:
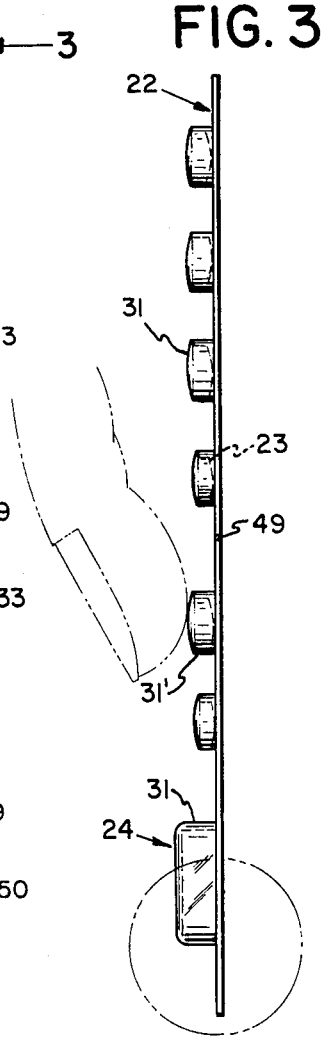
FIG. 3 is a side cross-sectional view taken along line 3—3 of FIG. 2 illustrating the carrier and pill-containing enclosures.
Figure 4:
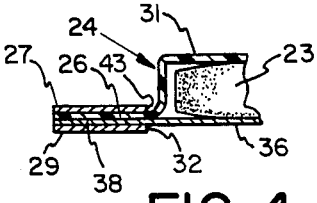

FIG. 4 is an enlarged view of the carrier and one pill-containing enclosure shown in FIG. 3 (the dotted circle) illustrating the upper and lower cardboard sheets forming the carrier, as well as the plastic sheet used to form the domes of the pill-containing enclosures and the metalized foil sheet used to form the rupturable zones for each such enclosure, the latter two sheets sandwiched between the cardboard sheets forming the carrier.

Figure 5:
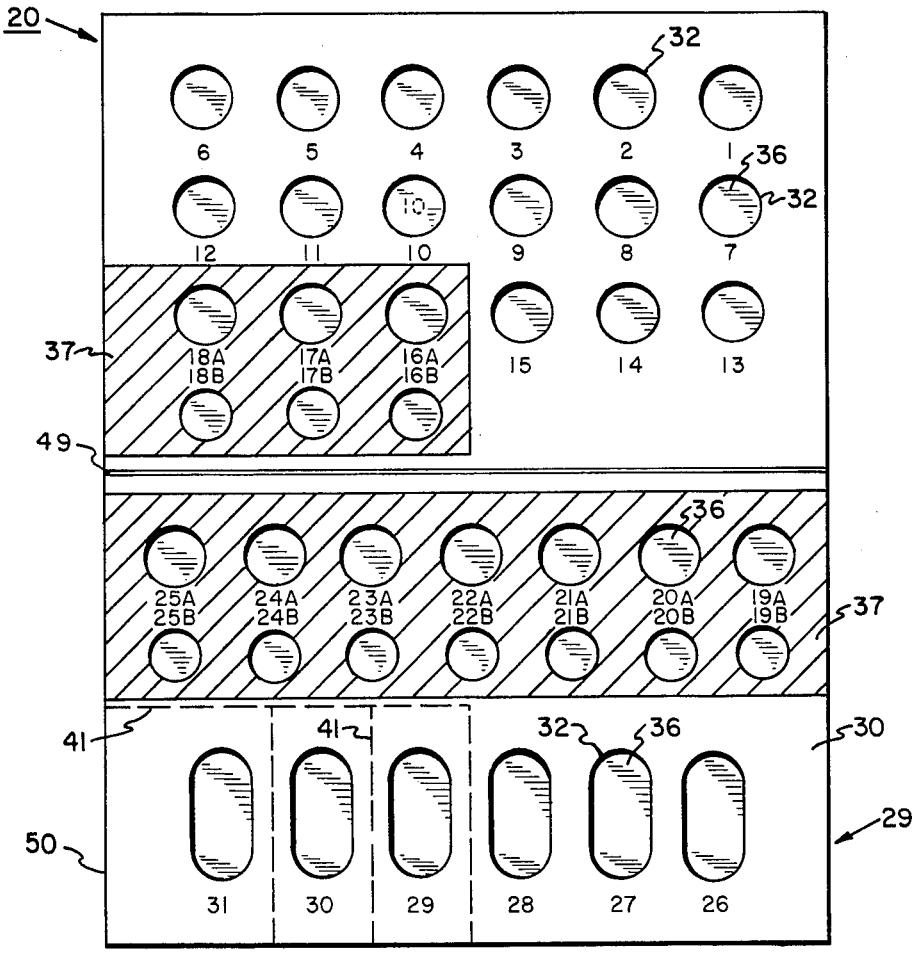

FIG. 5 is a bottom plan view of the carrier in its opened state showing the cutout portions on the rear surface of the carrier which overlie the pill-containing enclosure rupturable zones formed by the foil sheet of the enclosures, and further showing that each such cutout portion and corresponding zone have indicia associated therewith which corresponds to the indicia shown on the front surface of the carrier corresponding to the calendar date for which the pill within the corresponding enclosure is to be taken by the patient.

Figure 2:
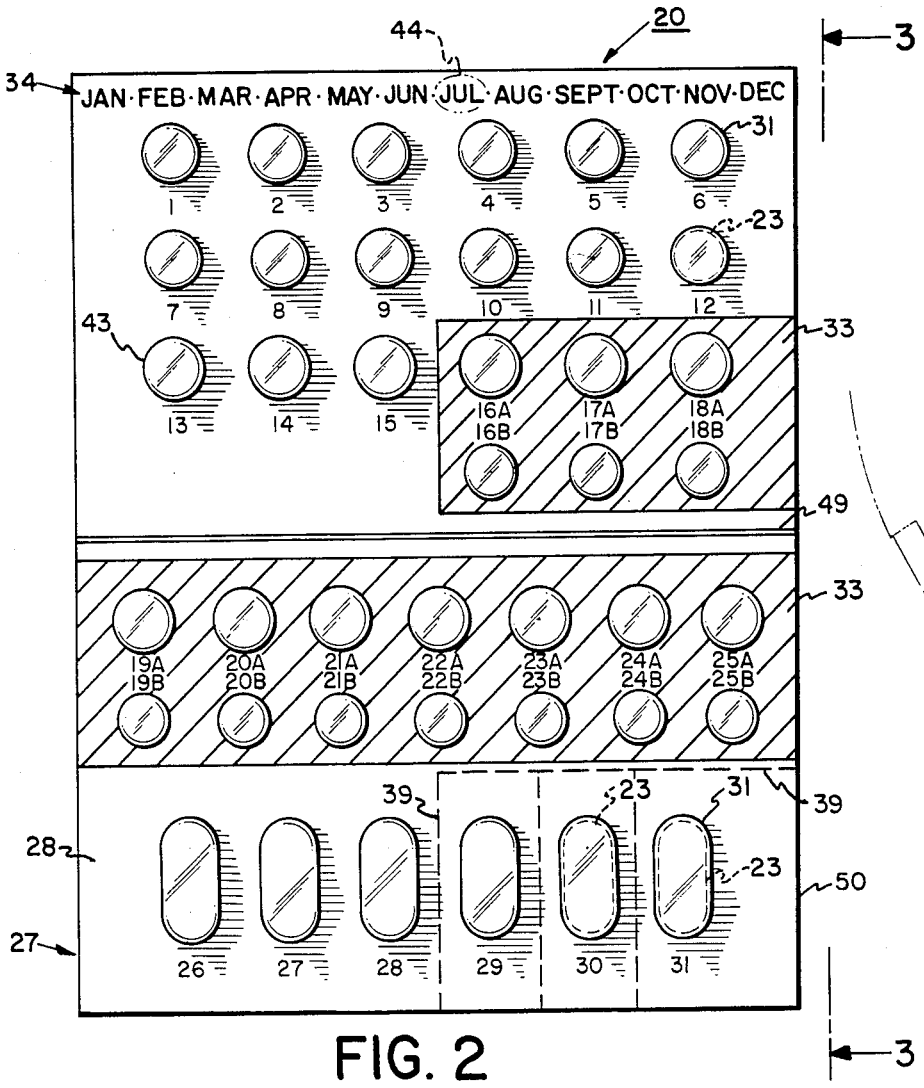
FIG. 2 is a top plan view of the carrier in its opened state illustrating the plurality of rows with pill-containing enclosures, each enclosure for the storage of one pill to be administered on a given calendar date, and further showing numerical indicia for the calendar date positioned in proximity to the pill-containing enclosure(s) associated with that calendar date.
Figure 6:
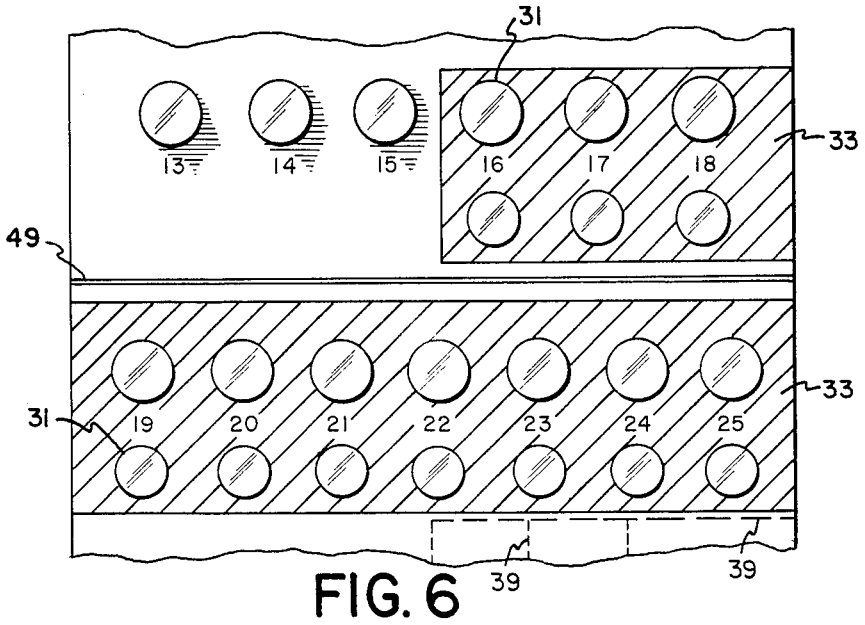

FIG. 6 is a partial top plan view of the carrier similar to that shown in FIG. 2 showing the use of one number with pairs of pill-containing enclosures associated with one calendar date.

BEST MODE FOR CARRYING OUT THE INVENTION

Figure 1:
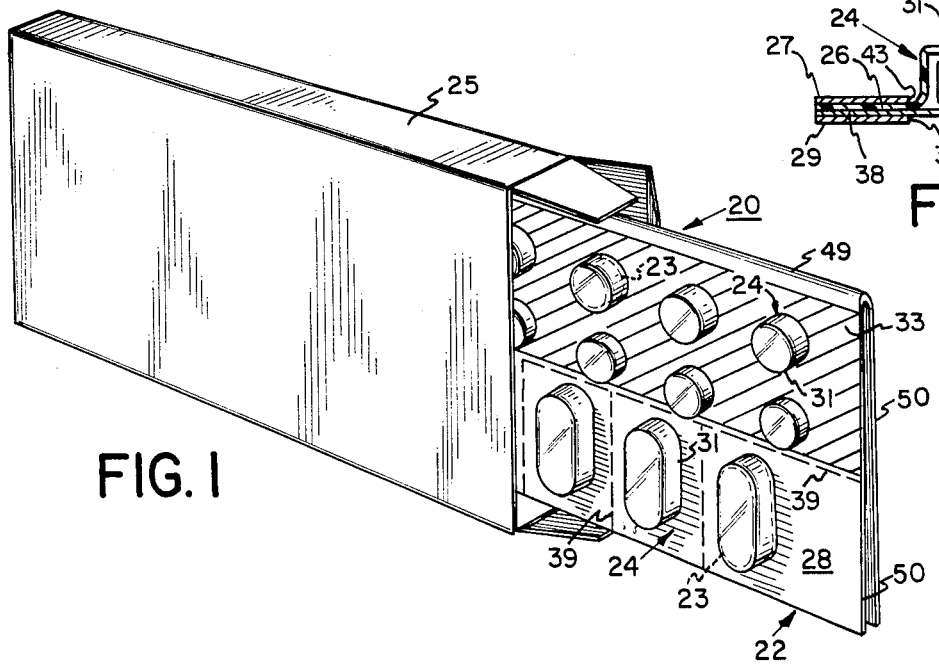
FIG. 1 is a perspective view of the dispenser according to the present invention, showing the pill-containing carrier partially removed from the storage carton, the carrier shown in its folded state and illustrating some of the pill-containing enclosures formed therein, but for purposes of clarity not showing the indicia associated with each enclosure.

As best seen in FIG. 1, a dispenser 20 for calendar oriented drugs comprises a carrier 22 onto which are positioned a plurality of pill-containing enclosures 24. Each enclosure is preferably dimensioned to store one pill 23 (shown in phantom for several enclosures). The dispenser may also include a carton 25 into which the carrier can be stored when in its folded position. As seen in FIGS. 1, 2, 3, 5 and 6, the carrier can be folded upon itself along line 49.

As seen in FIGS. 1, 2, 3 and 4, the carrier 22 has a relatively thin cross-section and is preferably made from relatively stiff sheet material, such as cardboard sheets 27 and 29. The carrier sheets may be attached to each other along a fold line 50 so as to facilitate printing and fabrication of the dispenser. The pill-containing enclosures have domes 31 preferably fabricated from a clear thermoplastic material forming part of an overall thermoplastic sheet 26. The plastic sheet is preferably made from polyvinyl chloride (PVC). As seen in FIGS. 4 and 5, the lower portion of each enclosure includes a rupturable zone 36 formed from a sheet-like material 38. The sheet-like material is preferably made from a metalized foil sheet.

As seen in FIG. 4, the plastic sheet 26 and the foil sheet 38 are sandwiched between the carrier's front and rear cardboard sheets 27 and 29 with domes 31 passing through cutouts 43 in sheet 27. The plastic sheet is also preferably adhesively attached to the foil sheet.

As also seen in FIGS. 1–4, each pill-containing enclosure is dimensioned to house a single pill 23. The front surface 28 of upper sheet 27 has a plurality of numerical indicia ranging from 1 to 31. Each indicia corresponds to a particular calendar date and to one of the pill-containing enclosures. For days when more than one pill-containing enclosure is to be dispensed, the numeral is repeated with an "A" and a "B"; such as for the sixteenth day, a 16A and a 16B are shown. Of course the particular days where two or more enclosures are to be used can vary depending upon the nature of the calendar oriented drug regimen.

The dispenser is thus particularly designed for the administration of a drug regimen to a user where the user takes one or more pills on each calendar day. The front surface of sheet 27 may optionally include indicia 34 indicating the particular month of the year for which the pills are to be taken. The particular month may then be identified by circling or the like, such as shown by oval 44 in FIG. 2.

As shown in FIGS. 3 and 5, the rear surface 30 of lower cardboard sheet 29 has a plurality of cutout regions or portions 32 which correspond to the rupturable zones 36 lying directly beneath the pill-containing enclosure domes 31. Each cutout portion and corresponding foil rupturable zone has an indicia associated with it in a manner similar to that placed on the front surface 28 of cardboard sheet 27. Although the indicia are preferably placed on the rear surface 30 of carrier sheet 29, they may also be placed directly on the rupturable zone 36 such as shown in phantom for day 10 (see FIG. 5). Each cutout portion 32 thus overlies a rupturable zone for the removal of the pill within the corresponding enclosure by merely pressing the corresponding pill-enclosure dome 31 such as shown in FIG. 3 for dome 31'.

For most calendar drug regimens, the user is instructed to take the pill in the enclosure(s) corresponding to the specific calendar date on only that date, and if the user forgets to take the pill(s) on a particular date it is left intact in the dispenser. In this manner, the attending physician can readily determine the degree of patient compliance to a specific drug regimen. Thus, for example, the user may be instructed to begin use of the dispenser on the first day of a particular calendar month, for example the month of August. In this case, the user for the first day of August would remove the pill in the enclosure identified by the indicia "1" and for the second day of August would remove the pill in the enclosure identified by the numeral "2", and so on. If, for example, the user forgets to take the pill for the fourth day of August, the pill in enclosure "4" is left in the dispenser. The patient then continues to take the remaining pills on the days corresponding to those associated with each enclosure; and thus, on fifth of August takes the pill contained in the enclosure identified by the numeral "5".

If the days of the particular month do not equal 31, then for those days exceeding the last day of the month the pills are simply left in the dispenser. If, for example, the user is taking calendar oriented drugs for the month of September, then the pill in the enclosure identified by the numeral "31" would be left in the dispenser. In this way, the attending physician can quickly ascertain the degree of patient compliance with the drug regimen and can insure that extra pills were not taken for extra days exceeding those of a particular calendar month. Alternatively, the physician or attending pharmacist can remove any excess pill-containing enclosures by tearing away those enclosures along corresponding score lines 39 and 41 as shown in FIGS. 1, 2 and 5.

Specifically for the administration of estrogen in estrogen replacement therapy treatment, the present invention provides a unique approach to maximizing patient compliance and providing the means for ascertaining this compliance. It has been recently discovered, as mentioned above, that post-menopausal women experience a decrease in estrogen and progesterone production which causes various physiological symptoms including sudden feelings of warmth in the face, neck, chest, and sudden intense episodes of heat and sweating throughout the body, commonly referred to as "hot flashes" or "hot flushes". These symptoms can be alleviated to a great extent by the administration of estrogen and progesterone. It has also been clinically determined that reduced production of estrogen and progesterone causes, in some women, osteoporosis; that is a reduction in their bone mass with a concomitant propensity for bone fractures. Therapeutic estrogen and progesterone replacement is believed to counteract to a great extent this reduction in bone mass which is related to a reduction in the calcium of the bone.

The present invention, when used for the administration of post-menopausal therapeutic purposes therefore provides estrogen for a period of 15 days, followed by 10 days of both estrogen and progesterone, followed by from 3 to 6 days of calcium replacement during the days that the patient does not take estrogen or a progesterone/estrogen combination. while the days that estrogen and estrogen/progesterone are taken these drugs act indirectly to retard bone mass depletion.

As best seen in FIGS. 2 and 5, for days 16 through 25 of each calendar month for which such a regimen is to be taken, two enclosures are associated with one calendar date. Separate indicia with an associated "A" or "B" further help identify which enclosures are to be dispensed on a given date. Also, the days where two enclosures are to be dispensed can have the corresponding front surface 28 and rear surface 30 color shaded such as shown by shaded regions 33 and 37.

FIG. 6 shows a top view of an alternative embodiment of the invention where one numerical indicia is used to identify two enclosures for a single calendar date. The bottom of the carrier in this embodiment would similarly use one indicia for the same enclosures.

When the present invention is used for post-menopausal therapy, one of the preferred drug regimens is presented in Table 1.

TABLE 1

| Days | Estrogen* | Progesterone* | Calcium*** |
|---|---|---|---|
| 1–15 | 0.625 mg/day | — | — |
| 16–25 | 0.625 mg/day | 5 mg/day | — |
| 26–end of month | — | — | 500 mg/day |

Another regimen for a smaller dosage of estrogen is presented in Table 2.

TABLE 2

| Days | Estrogen* | Progesterone* | Calcium*** |
|---|---|---|---|
| 1–15 | 0.3 mg/day | — | — |
| 16–25 | 0.3 mg/day | 5 mg/day | — |
| 26–end of month | — | — | 500 mg/day |

Another drug regimen using a higher dosage of progesterone is given in Table 3.

TABLE 3

| Days | Estrogen* | Progesterone* | Calcium*** |
|---|---|---|---|
| 1–15 | 0.625 mg/day | — | — |
| 16–25 | 0.625 mg/day | 10 mg/day | — |
| 26–end of month | — | — | 500 mg/day |

*Estrogen in the form of conjugated estrogen.
**Progesterone in the form of medroxyprogesterone acetate.
***Calcium in the form of calcium carbonate.

The particular regimen to use would, of course, be determined by the attending physician.

In a clinical study performed by joint inventor Walter G. Leonard, M.D., it has been found that patient compliance becomes extremely good when estrogen replacement therapy is conducted through a dispenser similar to the present invention.

Thus the present invention has been found to provide an effective means for the proper administration of calendar oriented drug regimens since it provides the user with a direct one-to-one correlation between the pill or pills to be taken on a particular date and the date as shown by the calendar for the given month. It also provides an easily verifiable record of the patient's compliance with the calendar oriented drug regimen.

The dispenser through the use of rupturable pill-containing enclosures having indicia on both the front and rear surfaces of the carrier provides an effective and easy-to-use device for both storing drugs and for their administration when directed to a calendar oriented regimen.

It will thus be seen that the objects set forth above, among those made apparent from the preceding description, are efficiently attained and, since certain changes may be made in carrying out the above construction and method set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed is:

1. A unitary, non-reuseable dispenser for the storage, dispensing, and patient compliance indication of calendar-oriented pills comprising:

(A) a plurality of pill-containing enclosures, each enclosure corresponding to only one day of a calendar month, and each day of the calendar month corresponding to at least one enclosure, each enclosure comprising a dome for overlying one pill and rupturable zone positioned below the dome for sealing said pill within the enclosure, said zone being rupturable by downward pressure on the dome so as to release the pill contained within the enclosure;

(B) a carrier comprising a first sheet overlying the domes of the plurality of pill-containing enclosures, the sheet comprising a plurality of cutouts dimensioned for passage therethrough of the enclosure domes, said cutouts positioned with respect to each other in a manner similar to the spatial relationship of the pill enclosures to each other, and a second sheet overlying the rupturable zones having cutouts corresponding in size to the size of the rupturable zones, said cutouts positioned with respect to each other in a manner similar to the spatial relationship of the rupturable zones to each other, so as to allow the pill released via the rupturable zone to passthrough the corresponding cutout in the second sheet;

(C) consecutive integer indicia corresponding to each day of the calendar month, the indicia positioned on the first sheet of the carrier in proximity to the domes so that each dome is identified by one and only one of said indicia for a single calendar date and thereby to visually identify each dome with one and only one calandar date of a calendar month; and (D) consecutive integer indicia corresponding to each day of the calendar month, the indicia positioned on the second sheet of the carrier in proximity to the rupturable zones so that each zone is identified by one and only one of said indicia for a single calendar date and thereby to visually identity each zone with one and only one calendar date of a calendar month;

whereby the dispenser stores pills in the plurality of pill-containing enclosures, wherein at least one enclosure corresponds to each day of a calendar month, and wherein the dispenser stores the pills in a manner that provides visual identification of each enclosure from both the front and rear of the dispenser with one and only one calendar date of a calendar month, so that dispensing of pills on a daily basis is facilitated and whereby monitoring of user compliance with the calendar oriented regimen is facilitated by identification of the pill-containing enclosures which are not dispensed for any given calendar date.

2. A dispenser as defined in claim 1 wherein at least some of the pill-containing enclosures are associated with the same calendar date.

3. A dispenser as defined in claim 2 wherein the rupturable zones are formed from a backing sheet which is positioned between the first and second sheets of the carrier.

4. A dispenser as defined in claim 3 wherein the domes of the pill-containing enclosures are formed from a plastic sheet which is positioned over the backing sheet and the combination of the plastic sheet and backing sheet being sandwiched between the first and second sheets of the carrier.

5. A dispenser as defined in claim 4 wherein the backing sheet is formed from a thin metalized foil sheet.

6. A dispenser as defined in claim 5 wherein the plastic sheet is formed from polyvinyl chloride (PVC).

7. A dispenser as defined in claim 6 further comprising indicia on the first sheet of the carrier for identifying the month for which the dispenser is to be used.

8. A dispenser as defined in claim 4 wherein the first and second sheets of the carrier are attached to each other along a fold line.

9. A dispenser as defined in claim 4 wherein the plurality of pill-containing enclosures are arranged in seven rows, the first three rows each comprising six enclosures corresponding to calendar days 1 through 18, wherein each of these enclosures contains an estrogen pill, wherein three enclosures are in the fourth row corresponding to calendar days 16, 17 and 18, respectively, wherein each of these enclosures contains a progesterone pill, wherein the fifth and sixth rows each contain six enclosures for calendar days 19 through 25, wherein the enclosures in the fifth row each contain an estrogen pill and the enclosures in the sixth row each contain a progesterone pill, and wherein the seventh row contains six enclosures for calendar days 26 through 31, wherein each of these enclosures contains a calcium pill.

10. A dispenser as defined in claim 9 wherein the integer indicia positioned on the second sheet of the carrier are placed within the area defined by the rupturable zones of each pill enclosure.

11. A dispenser as defined in claim 9 wherein the first and second sheets of the carrier are further defined by a fold line extending between the fourth and fifth rows of pill-containing enclosures so that the carrier can be folded upon itself along this line; and wherein the dispenser further comprises a carton dimensioned for receipt of the folded carrier.

12. A dispenser as defined in claim 11 wherein the first and second sheets of the carrier each comprise a shaded portion surrounding the pill-containing enclosures corresponding to the calendar days in which more than one pill is to be dispensed for the given calendar day.

13. A dispenser as defined in claim 12 wherein the consecutive indicia comprise unique indicia for each pill-containing enclosure for those days of the calendar month in which more than one pill is to be dispensed.

14. A dispenser as defined in claim 13 further comprising score lines in the first and second carrier sheets about the pill-containing enclosure for days 29 through 31, the score lines thereby facilitating removal of the enclosures identified by calendar days 29, 30 or 31 so as to remove any of such enclosures for months having fewer calendar days.

15. A dispenser as defined in claim 14 further comprising indicia on the first sheet of the carrier for identifying the month for which the dispenser is to be used.

16. A dispenser as defined in claim 14 wherein the integer indicia positioned on the second sheet of the carrier are placed within the area defined by the rupturable zones of each pill enclosure.

17. A dispenser as defined in claim 1 further comprising indicia on the first sheet of the carrier for identifying the month for which the dispenser is to be used.

18. A dispenser as defined in claim 1 wherein the integer indicia positioned on the second sheet of the carrier are placed within the area defined by the rupturable zones of each pill enclosure.

19. A dispenser as defined in claim 1 wherein the first and second sheets of the carrier are attached to each other along a fold line.

20. A dispenser as defined in claim 1 wherein the first and second sheets of the carrier are further defined by a fold line extending across their surfaces so that the carrier can be folded upon itself along this line; and wherein the dispenser further comprises a carton dimensioned for receipt of the folded carrier.

21. A dispenser as defined in claim 2 wherein the first and second sheets of the carrier each comprise a shaded portion surrounding the pill-containing enclosures corresponding to the calendar days in which more than one pill is to be dispensed for the given calendar day.

22. A unitary, non-reuseable dispenser for the storage, dispensing, and patient compliance indication of post-menopausal calendar-oriented estrogen therapy pills comprising:

(A) a backing sheet formed from a thin metalized foil sheet containing a plurality of rupturable zones, the zones arranged in seven rows, the first three rows each comprising six zones corresponding to calendar days 1 through 18, each zone dimensioned for underlying one estrogen pill, the fourth row containing three rupturable zones corresponding to calendar days 16–18, each zone dimensioned for underlying a progesterone pill, the fifth row containing six rupturable zones corresponding to calendar days 19 through 25, each zone dimensioned for underlying an estrogen pill, the sixth row containing six rupturable zones also corresponding to calendar days 19 through 25, each zone dimensioned for underlying a progesterone pill, and the seventh row containing six rupturable zones corresponding to calendar days 26 through 31, each dimensioned for underlying a calcium replacement pill;

(B) a plastic sheet sealingly positioned over the backing sheet, the plastic sheet having a plurality of domes formed therein, each dome dimensioned for overlying one of the rupturable zones so as to form a pill-containing enclosure dimensioned for receipt of one pill of the calendar-oriented estrogen therapy regimen to be stored and dispensed by the dispenser;

(C) a carrier having a first sheet overlying the domes of the plastic sheet, the first sheet having a plurality of cutouts dimensioned and spaced with respect to each other so as to allow the domes to protrude through the sheet, and a second sheet overlying the backing sheet, the second sheet also having a plurality of cutouts dimensioned and spaced with respect to each other so as to allow the rupturable zones formed in the backing sheet to be exposed; and (D) consecutive indicia positioned on the first sheet of the carrier, the indicia representing integers from the numeral one to thirty-one, each indicia positioned in proximity to each dome to be dispensed on a particular calendar day so as to visually identify each dome with one and only one calendar date;

whereby the user of the calendar-oriented dispenser can easily identify each pill to be dispensed on a given calendar date, wherein the dispenser facilitates compliance with the post-menopausal estrogen therapy calendar-oriented regimen and whereby compliance with the regimen can be ascertained by determining which domes of the pill-containing enclosures contain pills at the completion of the calendar-oriented regimen for a given calendar month.

23. A dispenser as defined in claim 22 further comprising consecutive indicia positioned on the second sheet of the carrier, the indicia representing integers from the numeral one to thirty-one, each indicia positioned in proximity to each rupturable zone associated with a particular calendar date.

24. A dispenser as defined in claim 22 wherein the first and second sheets of the carrier are further defined by a fold line extending between the fourth and fifth rows of pill-containing enclosures so that the carrier can be folded upon itself along this line; and wherein the dispenser further comprises a carton dimensioned for receipt of the folded carrier.

25. A dispenser as defined in claim 24 wherein the consecutive indicia comprise unique indicia for each pill-containing enclosure for those days of the calendar month in which more than one pill is to be dispensed.

26. A dispenser as defined in claim 25 wherein the first sheet of the carrier further comprises a shaded portion surrounding the pill-containing enclosures corresponding to the calendar days in which more than one pill is to be dispensed for the given calendar day.

27. A dispenser as defined in claim 26 further comprising indicia identifying a particular month of the year for which the dispenser is to be used.

28. A dispenser as defined in claim 27 further comprising score lines in the first and second carrier sheets about the pill-containing enclosures for days 29 through 31, the score lines thereby facilitating removal of the enclosures identified by calendar days 29, 30 or 31 so as to remove any of such enclosures for months having fewer calendar days.

29. A dispenser as defined in claim 23 wherein the first and second sheets of the carrier each comprise a shaded portion surrounding the pill-containing enclosures corresponding to the calendar days in which more than one pill is to be dispensed for the given calendar day.

30. A dispenser as defined in claim 29 wherein the first and second sheets of the carrier are further defined by a fold line extending between the fourth and fifth rows of pill-containing enclosures so that the carrier can be folded upon itself along this line; and wherein the dispenser further comprises a carton dimensioned for receipt of the folded carrier.

31. A dispenser as defined in claim 30 wherein the consecutive indicia comprise unique indicia for each pill-containing enclosure for those days of the calendar month in which more than one pill is to be dispensed.

32. A dispenser as defined in claim 31 further comprising indicia identifying a particular month of the year for which the dispenser is to be used.

33. A dispenser as defined in claim 32 further comprising score lines in the first and second carrier sheets about the pill-containing enclosure for days 29 through 31, the score lines thereby facilitating removal of the enclosures identified by calendar days 29, 30 or 31 so as to remove any of such enclosures for months having fewer calendar days.

34. A dispenser as defined in claim 33 wherein the first and second sheets of the carrier are attached to each other along a fold line.

35. A dispenser as defined in claim 22 further comprising score lines in the first and second carrier sheets about the pill-containing enclosure for days 29 through 31, the score lines thereby facilitating removal of the enclosures identified by calendar days 29, 30 or 31 so as to remove any of such enclosures for months having fewer calendar days.

36. A dispenser as defined in claim 22 wherein the first and second sheets of the carrier are attached to each other along a fold line.

37. A unitary, non-reuseable dispenser of pills for the storage, dispensing and patient compliance indication of a post-menopausal oriented estrogen regimen comprising:

(A) a backing sheet containing a plurality of rupturable zones, the zones arranged in a plurality of rows, a first group of such zones corresponding to a first set of calendar days for which an estrogen pill is to be taken on each day, a second group of such zones corresponding to a second set of calendar days for which a progesterone pill is to be taken on each day, and a third group of such zones corresponding to a third group of calendar days for which a calcium pill is to be taken on each day;

(B) a plastic sheet sealingly positioned over the backing sheet, the plastic sheet having a plurality of domes formed therein, each dome dimensioned for overlying one of the rupturable zones so as to form a pill-containing enclosure dimensioned for receipt of one pill of the calendar-oriented regimen to be stored and dispensed by the dispenser;

(C) a carrier having a first sheet overlying the domes of the plastic sheet, the first sheet having a plurality of cutouts dimensioned and spaced with respect to each other so as to allow the domes to protrude through the sheet, and a second sheet overlying the backing sheet, the second sheet also having a plurality of cutouts dimensioned and spaced with respect to each other so as to allow the rupturable zones formed in the backing sheet to be exposed; and (D) consecutive indicia positioned on the first sheet of the carrier, the indicia representing integers corresponding to at least the maximum number of days of a particular calendar month for which the dispenser is to be used so as to visually identify each zone with one and only one calendar date;

whereby the user of the calendar-oriented dispenser can easily identify each pill to be dispensed on a given calendar date, wherein the dispenser facilitates compliance with the post-menopausal estrogen therapy regimen and whereby compliance with the regimen can be ascertained by determining which domes of the pill-containing enclosures contain pills at the completion of the calendar-oriented regimen for a given calendar month.

38. A dispenser as defined in claim 37 wherein the second group of zones corresponding to a second set of calendar days correspond to at least some of the same calendar days of the first group of zones; wherein for such corresponding calendar days an estrogen pill and progesterone pill are to be dispensed.

39. A dispenser as defined in claim 38 further comprising consecutive indicia positioned on the second sheet of the carrier, the indicia representing integers corresponding to at least the maximum number of days of a particular calendar month for which the dispenser is to be used so as to visually identify each zone with one and only one calendar date.

40. A dispenser as defined in claim 39 wherein the first and second sheets of the carrier are further defined by a fold line extending across their surfaces so that the carrier can be folded upon itself along this line; and wherein the dispenser further comprises a carton dimensioned for receipt of the folded carrier.

41. A dispenser as defined in claim 40 wherein the consecutive indicia comprise unique indicia for each pill-containing enclosure corresponding to days of the calendar month in which more than one pill is to be dispensed.

42. A dispenser as defined in claim 41 wherein the first sheet of the carrier further comprises a shaded portion surrounding the pill-containing enclosures corresponding to the calendar days in which more than one pill is to be dispensed for the given calendar day.

43. A dispenser as defined in claim 42 further comprising indicia identifying a particular month of the year for which the dispenser is to be used.

44. A dispenser as defined in claim 43 wherein the third set of calendar days includes days corresponding to days 29, 30 and 31, wherein the dispenser further comprises score lines in the first and second carrier sheets about the pill-containing enclosures for days 29 through 31, the score lines thereby facilitating removal of the enclosures identified by calendar days 29 through 31 so as to remove any of such enclosures for months having fewer calendar days.

45. A dispenser as defined in claim 38 wherein the first and second sheets of the carrier each comprise a shaded portion surrounding the pill-containing enclosures corresponding to the calendar days in which more than one pill is to be dispensed for the given calendar day.

46. A dispenser as defined in claim 45 wherein the first and second sheets of the carrier are further defined by a fold line extending across their surfaces so that the carrier can be folded upon itself along this line; and wherein the dispenser further comprises a carton dimensioned for receipt of the folded carrier.

47. A dispenser as defined in claim 46 wherein the consecutive indicia comprise unique indicia for each pill-containing enclosure for those days of the calendar month in which more than one pill is to be dispensed.

48. A dispenser as defined in claim 47 further comprising indicia identifying a particular month of the year for which the dispenser is to be used.

49. A dispenser as defined in claim 48 further comprising score lines in the first and second carrier sheets about the pill-containing enclosure for days 29 through 31, the score lines thereby facilitating removal of the enclosures identified by calendar days 29, 30 or 31 so as to remove any of such enclosures for months having fewer calendar days.

50. A dispenser as defined in claim 49 wherein the first and second sheets of the carrier are attached to each other along a fold line.

51. A dispenser as defined in claim 37 wherein the third set of calendar days includes days corresponding to days 29, 30 and 31, wherein the dispenser further comprises score lines in the first and second carrier sheets about the pill-containing enclosures for days 29 through 31, the score lines thereby facilitating removal of the enclosures identified by calendar days 29 through 31 so as to remove any of such enclosures for months having fewer calendar days.

52. A dispenser as defined in claim 37 wherein the first and second sheets of the carrier are attached to each other along a fold line.

53. A method of dispensing pills which is intended to be taken on a calendar-oriented basis comprising the steps of:

(1) providing a unitary, non-reuseable dispenser, and said dispenser having:

(A) a plurality of pill-containing enclosures, each enclosure corresponding to only one day of a calendar month, and each day of the calendar month corresponding to at least one enclosure, each enclosure comprising a dome for overlying one pill and rupturable zone positioned below the dome for sealing said pill within the enclosure, said zone being rupturable by downward pressure on the dome so as to release the pill contained within the enclosure;

(B) a carrier comprising a first sheet overlying the domes of the plurality of pill-containing enclosures, the sheet comprising a plurality of cutouts dimensioned for passage therethrough of the enclosure domes, said cutouts positioned with respect to each other in a manner similar to the spatial relationship of the pill enclosures to each other, and a second sheet overlying the rupturable zones having cutouts corresponding in size to the size of the rupturable zones, said cutouts positioned with respect to each other in a manner similar to the spatial relationship of the rupturable zones to each other, so as to allow the pill released via the rupturable zone to pass through the corresponding cutout in the second sheet;

(C) consecutive integer indicia corresponding to each day of the calendar month, the indicia positioned on the first sheet of the carrier in proximity to the domes so that each dome is identified by one and only one of said indicia for a single calendar date and thereby to visually identify each dome with one and only one calendar date of a calander month; and (D) consecutive integer indicia corresponding to each day of the calendar month, the indicia positioned on the second sheet of the carrier in proximity to the rupturable zones so that each zone is identified by one and only one of said indicia for a single calendar date and thereby to visually identify each zone with one and only one calendar date of a calendar month;

(2) storing the pills to be dispensed for each calendar date of a calendar month in said dispenser and (3) rupturing the rupturable zone of the pill-containing enclosure corresponding to the calendar day for which the medication is to be dispensed.

54. A method of dispensing pills as defined in claim 53, wherein the step of providing a non-reuseable dispenser further comprises the step of arranging the pill-containing enclosures in seven rows, wherein the first three rows each comprise six enclosures corresponding to calendar days 1 through 18, wherein each of these enclosures contains an estrogen pill, wherein three closures are in the fourth row corresponding to calendar days 16, 17 and 18, respectively, wherein each of these enclosures contains a progesterone pill, wherein the fifth and sixth rows each contain six enclosures for calendar days 19 through 25, wherein the enclosures in the fifth row each contain a progresterone pill, and wherein the seventh row contains six enclosures for calendar days 26 and 31, wherein each of these enclosures contains a calcium pill.

55. A method of dispensing pills as defined in claim 54 further wherein the indicia corresponding to a particular calendar date include separate indicia for each pill-containing enclosure to be dispensed on that calendar date.

56. A method of dispensing pills as defined in claim 55 further comprising the step of shading those portions of first sheet of the carrier corresponding to days of the calendar month for which more than one pill-containing enclosure is to be dispensed.

57. A method of dispensing pills as defined in claim 56 comprising the step of folding the carrier in half when not in use and storing the folded carrier in a carton.

58. A method of dispensing pills as defined in claim 57 further comprising the step of scoring the carrier about those pill-containing enclosures corresponding to calendar days 29, 30 and 31 so as to facilitate removal of the enclosures for months having fewer calendar days.

* * * * *